US005658092A

United States Patent [19]

Sweers

[11] Patent Number: 5,658,092

[45] Date of Patent: Aug. 19, 1997

[54] ADJUSTABLE DOWNSPOUT EXTENSION ASSEMBLY

[76] Inventor: Ronald L. Sweers, 6165 E. Atherton Rd., Burton, Mich. 48519

[21] Appl. No.: 529,435

[22] Filed: Sep. 18, 1995

[51] Int. Cl.[6] ..... E02B 5/00

[52] U.S. Cl. ..... 405/118; 52/11; 52/16; 137/615; 405/52; 405/121

[58] Field of Search ..... 405/119, 118, 405/120, 121, 52; 137/615, 801; 52/11–16; 285/176

[56] References Cited

U.S. PATENT DOCUMENTS

| | | | |
|---|---|---|---|
| 1,031,829 | 7/1912 | Adams | 193/16 |
| 1,718,460 | 6/1929 | Hansen et al. . | |
| 3,048,983 | 8/1962 | Crummel | 405/119 |
| 3,316,928 | 5/1967 | Weakley | 137/119 |
| 3,375,851 | 4/1968 | Henry et al. | 137/615 |
| 3,861,419 | 1/1975 | Johnson | 137/615 |
| 3,911,954 | 10/1975 | Johnson | 137/615 |
| 4,552,260 | 11/1985 | Teagno et al. | 198/345 |
| 4,711,334 | 12/1987 | Barry et al. | 403/378 X |
| 5,154,271 | 10/1992 | Binzen | 193/30 |
| 5,358,006 | 10/1994 | Sweers | 137/615 |

*Primary Examiner*—Dennis L. Taylor

*Attorney, Agent, or Firm*—Gifford, Krass, Groh, Sprinkle, Patmore, Anderson & Citkowski, P.C.

[57] ABSTRACT

An adjustable extension assembly for a downspout includes a fixed piece attachable to the lowermost end of a downpipe, a rotatable collar attached to the fixed piece, and at least one extension pivotally attached to the rotatable collar. Additional slidable members may be telescopingly attached to the extension. The extension members are channel-shaped in cross-section. The extension may be composed of a polymerized material or a metal. In addition to being easily attached to a downspout, the adjustable extension of the present invention may be selectively adjusted for fitting, for selective water deflection, and for proper lawn maintenance.

5 Claims, 3 Drawing Sheets

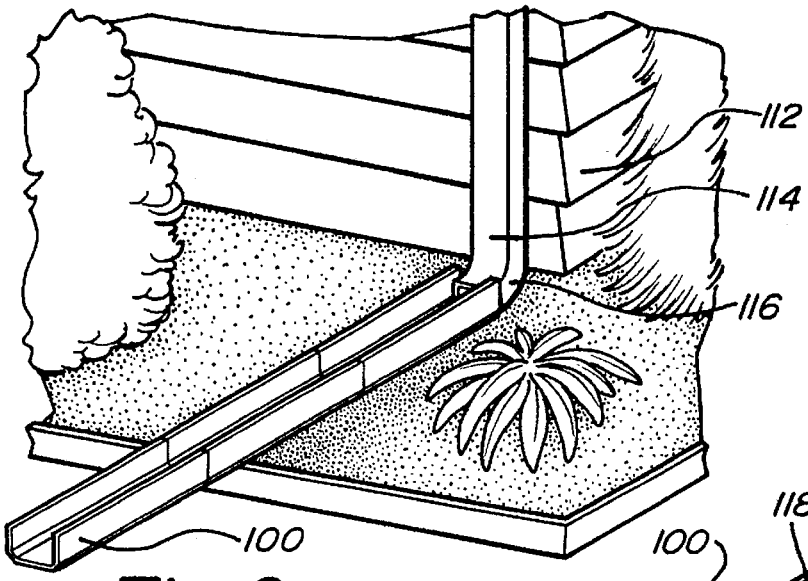
Fig-6
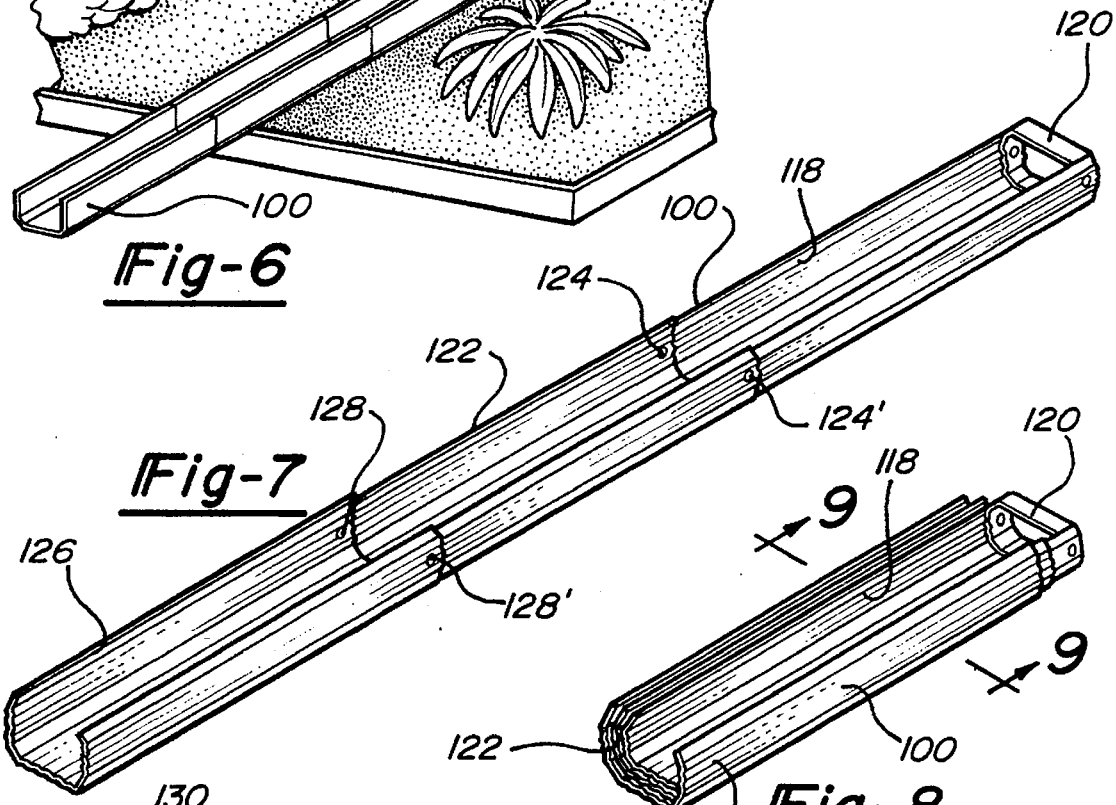
Fig-7
Fig-8
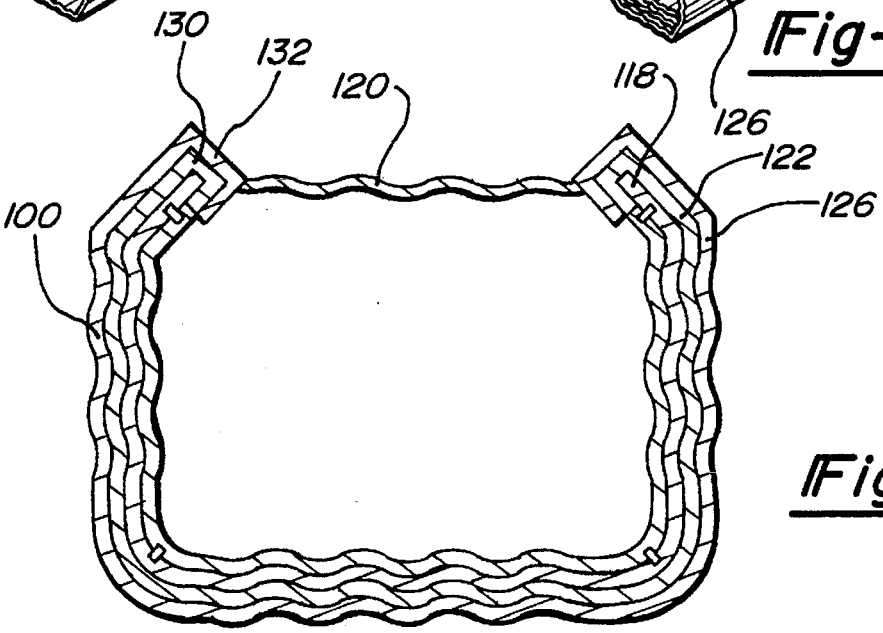
Fig-9

ADJUSTABLE DOWNSPOUT EXTENSION ASSEMBLY

BACKGROUND OF THE INVENTION

I. Field of the Invention

The present invention relates to an extension assembly for rainwater downspouts. More particularly, the present invention relates to a multi-pieced, telescoping extension assembly that is attachable to the lowermost end of an existing downspout in place of the elbow. The extension is preferably composed of four pieces, including a fixed piece attached to the downspout, a rotatable collar rotatably attached to the fixed piece, a first extension telescopingly attached to the rotatable collar, and a second extension telescopingly attached to the first extension. The extension assembly and the rotatable collar may be used separately or in combination.

II. Description of the Relevant Art

For centuries architects of all types of buildings have devised methods for collecting rainwater as it is deflected from the roof of a house and for directing the rainwater away from the rooftop in an orderly fashion. Early gutter systems were composed of slate, stone or wood.

Later improvements of gutters included the composition of gutters and downspouts from lead or copper. Both of these materials were found to be substantially water-resistant and malleable.

Construction of gutter system components from these materials was accomplished skillfully. In some instances, downspout openings were shaped to resemble animal heads whereby exhausting water flowed from the open mouths of the imitated creature. At other times gutter systems were fashioned to improve aesthetic appeal.

In more practical applications, modern day homes incorporate fiberglass, plastic or aluminum gutter and downspout systems. The downspout is fluidly interconnected with a gutter. The gutter itself is at a slight, but substantially unnoticeable incline in the direction toward the interattached downspout, thus preventing the water from collecting in a particular spot.

The most common problem with known gutter systems is that the elbow of the downspout, that part provided at the base of the downspout, only directs water slightly away from the house, perhaps to a length of eight inches. It is this small distance that allows water to be exhausted too close to the footings or basement of the house, thus causing foundation cracking and leaking. Evidence of collecting water may be seen as washed-out regions closely situated to the foundation. Another common problem with known gutter systems is that the elbow is fixed so that the water passing therethrough is directed only in one direction.

In partial response to these problems, downspout extensions of one-pieced construction are known. These are actually three to four foot lengths of straight downspout material that have been added to the elbow. While this known solution solves the immediate problem of water collected too close to the house by directing it a considerable distance away, this fixed, one-pieced extension creates another problem, which is that the extended downspout is a hazard. Not only does the extension make mowing the lawn difficult because the extension must first be removed before the area therebeneath may be cut, but it also provides an object over which people, particularly inattentive children, may trip. Known extensions are also difficult to install because they typically have to be cut to fit as they are often provided in only one size. Additionally, as they are preferably easily removed for mowing, they are not well-secured.

In any event, the provision of an extension does not overcome the problem of the singular direction of water travel because of the fixed relation of the elbow and the downpipe. Even with an extension, water may undesirably collect in one spot, or that spot to which the water is directed.

Known approaches to providing downspout extension assemblies have failed to overcome the problems inherent in such assemblies.

SUMMARY OF THE PRESENT INVENTION

The present invention provides a downspout extension assembly which overcomes problems inherent in presently-known extensions. The extension comprises a rotatable, multi-sectioned, telescoping extension assembly that is attachable to the lowermost end of the existing downspout. The extension of the present invention may be extended or retracted as may be desired for installation, adjustment, and for lawn mowing. It may also be rotated in one direction or the other to relocate water flow or for maintenance of the surrounding area.

The extension assembly of the present invention comprises two portions which may be used separately or may be used in combination. The first portion is the rotatable collar portion and the second portion the extension portion.

The first portion replaces the elbow of the downspout assembly and comprises a fixed collar adaptor that is attached to the lowermost end of the straight downspout. The fixed collar adaptor has a collar-receiving wall at its lowermost end. A rotatable collar is pivotally mounted to the collar-receiving wall of the fixed collar adaptor. Pivotally attached to the rotatable collar is a gutter extension.

The second portion is a telescoping gutter extension that may be used in combination with the first portion or may be attached directly to the elbow of the downspout assembly. The second portion comprises a first extension, one end of which is fixedly attached to the downspout elbow. Slidably attached to the first extension is a slidable extension. Additional slidable extensions may be telescopingly fitted to the first slidable extension so as to provide a length extendable to approximately nine feet from a retracted size of approximately three feet.

The first extension and the one or more slidable extensions each defines a U-shaped channel in cross-section. This open-topped construction allows for easy cleaning and free water flow.

Both portions of the adjustable downspout extension assembly of the present invention may be composed of a polymerized material such as fiberglass or plastic, or it may be composed of a metal such as aluminum.

According to the design of the present invention, the adjustable downspout extension assembly may be easily installed, easily adjusted to fit, readily retracted for lawn maintenance, and readily moved about to change water flow.

Other advantages and features of the present invention will become more apparent from the following detailed description when read in conjunction with the accompanying drawings.

BRIEF DESCRIPTION OF THE DRAWINGS

The present invention will be more fully understood by reference to the following detailed description of the preferred embodiments when read in conjunction with the accompanying drawings, in which like reference characters refer to like parts throughout the views, and in which:

FIG. 6 is an environmental view of another embodiment of the assembly of the present invention;

FIG. 7 is a perspective view of the assembly of FIG. 6 shown in its fully extended position;

FIG. 8 is a perspective view of the assembly of FIG. 6 shown in its fully retracted position; and FIG. 9 is a sectional view taken along line 9—9 of FIG. 8.

DETAILED DESCRIPTION OF THE PREFERRED EMBODIMENTS OF THE PRESENT INVENTION

The drawings disclose the preferred embodiments of the present invention. While the configurations according to the illustrated embodiments are preferred, it is envisioned that alternate configurations of the present invention may be adopted without deviating from the invention as portrayed. The preferred embodiments are discussed hereafter.

Figure 1:
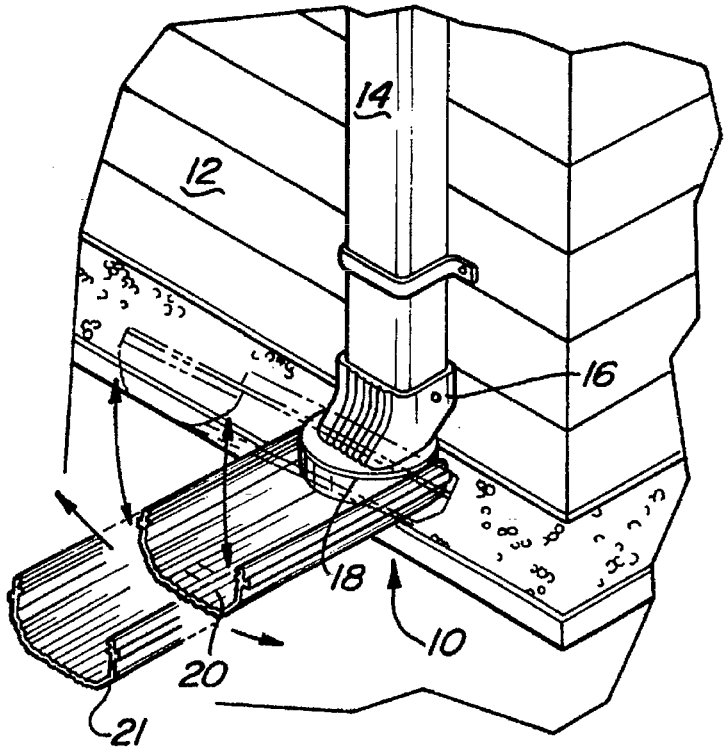
FIG. 1 is an environmental view of the extension assembly of the present invention.

Referring to FIG. 1, a first embodiment of an adjustable downspout extension assembly according to the present invention is shown generally at 10. The assembly 10 is shown in its approximate environment near a house or similar structure, generally indicated as 12. Fitted to the side of the house 12 is a downspout 14. The assembly 10 is fitted to the lowermost end of the downspout 14 in place of the conventionally-provided downspout elbow (not shown). The assembly 10 comprises a fixed collar adaptor 16, a rotatable collar 18 (or female collar 18) and a first rainwater extension 20. As illustrated by the shadow lines, the first rainwater extension 20 is pivotally mounted on the rotatable collar 18.

Figure 4:
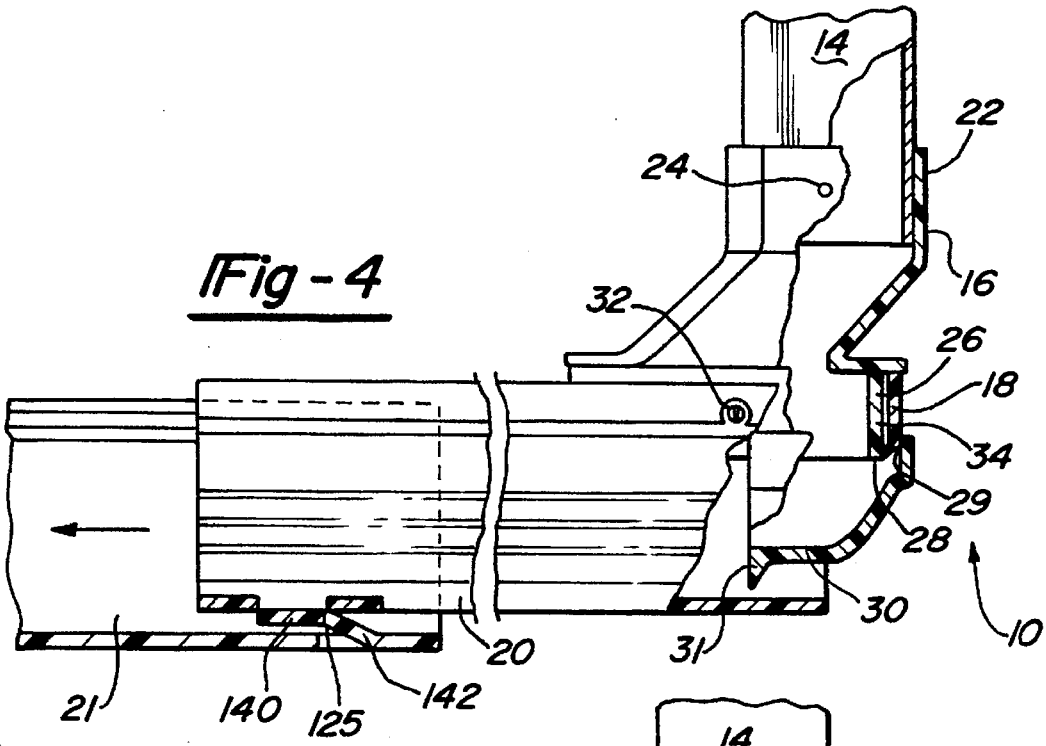
FIG. 4 is a side view of the extension assembly of the present invention shown in partial cross section and showing extension stops.

With reference to FIG. 4, a side view of the assembly 10 is illustrated and is shown in partial cross-section. The uppermost part of the adaptor 16 includes a downspout receptacle 22 into which the lowermost end of the downspout 14 is inserted. The receptacle 22 and the end of the downspout 14 are fastened together with a fastener 24.

The lowermost end of the adaptor 16 has defined thereon a male attachment collar 26. Along the lower-most edges of the attachment collar 26 are provided one or more interlocking ledges 28 each fitted to a cantilevered tab 34. The ledges 28 of the tabs 34 fit beneath the lowermost portion of the rotatable collar 18 on an interlocking tab abutment surface 29, and thereby hold it in place in relation to the fixed collar adaptor 16. In this relation, however, the ledges 28 permit the collar 18 to rotate upon the fixed collar adaptor 16.

The lowermost portion of the rotatable collar 18 is open to allow the flow of water therethrough. A rain deflector 30 is fitted to the lowermost portion and covers about one half of the opening. The deflector 30 directs the rainwater into the first rainwater extension 20 and away from the structure 12. In a preferred embodiment, the rain deflector 30 further comprises a downwardly extending lip 31 along the bottom edge of the deflector 30 adjacent the opening. The lip 31 helps to prevent backflow of the rainwater. The first rainwater extension 20 is pivotally attached to the rotatable collar 18 by a fastener 32. As may be understood by reference to FIG. 4, one end of the first rainwater extension 20 extends under the deflector 30 to also assure that no back splashing of rainwater occurs.

Figure 2:
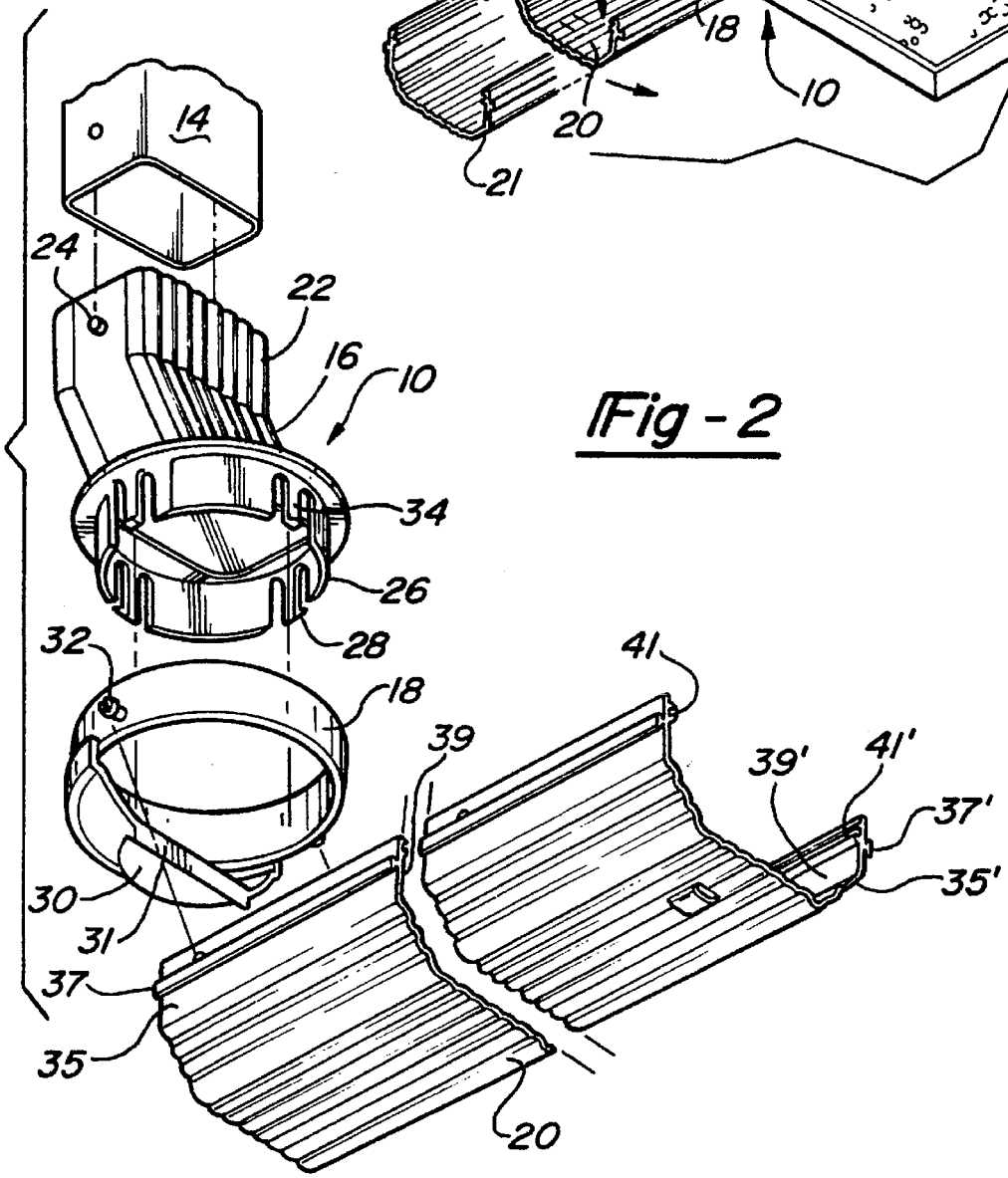
FIG. 2 is an exploded view of the extension assembly of the present invention.

Referring to FIG. 2, an exploded view of the assembly 10 is illustrated. This view better illustrates the construction of the male attachment collar 26. As illustrated, the interlocking ledges 28 are disposed at the ends of the cantilevered tabs 34 of the male attachment collar 26. This construction permits the ledges 28 to be slightly depressed for attachment of the rotatable collar 18. Once the collar 18 is installed, the tabs 34 return to their substantially vertical positions and the ledges 28 lock beneath the rotatable collar 18 onto the interlocking tab abutment surface 29 to hold it in place against the fixed collar adaptor 16 while allowing the collar 18 to freely rotate thereupon.

FIGS. 2 and 4 also illustrate the preferred construction of the rain deflector 30 including the downwardly extending lip 31. As may be seen, one end of the extension 20 extends below the rain deflector 30.

The components of the assembly 10 are preferably composed of a polymerized material such as a plastic, although they may be alternatively composed of a metal.

The first rainwater extension 20 can be a single piece. However, it may be desired that this extension be multiple-pieced and extendable. Accordingly, the present invention provides an extension system. The extension system shown in FIGS. 1 through 9 may be used separately or in conjunction with the rotatable adaptor embodiment of FIGS. 1 through 5.

The preferred method of interconnection of the extension channels of the present invention is also shown in FIGS. 2 and 6 through 9. As shown in FIG. 2, the first rainwater extension 20 is illustrated as having a right outer side 35 and a left outer side 35'. Fitted to the right outer side 35 is a T-shaped outer sliding member 37 and fitted to the left outer side 35' is a T-shaped outer sliding member 37'. The first rainwater extension 20 also includes a right inner side 39 and a left inner side 39'. Fitted to the right inner side 39 is an inner sliding member 41 and fitted to the left inner side 39' is an inner sliding member 41'. Both of the inner sliding members 41, 41' have T-shaped slots defined therein.

Although as mentioned above only one extension channel (the first rainwater extension channel 20) is illustrated, it is understood that additional identical channels, such as a second rainwater extension (not shown), may be fitted to the first rainwater extension channel 20 as illustrated below with respect to FIGS. 4 through 9. Mating of one or more additional channels to the first rainwater extension channel 20 according to the embodiment shown in FIG. 2 is made possible by fitting a T-shaped outer sliding member into the T-shaped slot of the inner sliding member as may be understood by reference to the figure.

Referring to FIG. 6, an adjustable downspout extension according to another aspect of the present invention is shown generally as 100. The extension 100 is shown as in its approximate environment near a house or similar structure, generally indicated as 112. Fitted to the side of the house 112 is a downspout 114, having at its lowest end an elbow 116. (The fixed collar 16 and the rotatable collar 18 of FIGS. 1 through 5 may be used in lieu of the elbow 116.) As illustrated, the extension 100 receives rainwater from the downspout 114 as it passes from the elbow 116. The extension 100 finally receives the water and directs it well away from the house 112, thus preventing water from damaging the foundation of the house 112. As may be understood, the extension may be telescopingly adapted to meet a required or preferred length. In addition, the extension 100 may be telescopingly retracted to allow for lawn and garden maintenance.

With reference to FIG. 7, the extension 100 is shown in isolation in its fully extended position. The extension 100 comprises a first member 118 that includes an attachment collar 120. The collar 120 is fixedly attached to the elbow 116.

A second telescoping extension member 122 is slidably fixed in relation to the first extension member 118. A pair of extension stops 124, 124' are provided between the first and second extension members 118, 122 and stoppingly engage the first extension 118 when the second telescoping extension member 122 has reached its maximum extended limit.

In a preferred embodiment, an extension stop 125 comprises the junction of an outward protrusion 140 on the first extension 20 and an inward protrusion 142 on the second extension 21, as best shown in FIG. 4.

With reference to FIG. 7, as may be preferred one or more additional telescoping members may be slidably connected to allow for additional extension. According to one embodiment, a third telescoping extension member 126 is shown and is slidably attached to the second telescoping extension member 122. As with the second member 122, a pair of stops 128, 128 are provided on the third telescoping member 126 to stoppingly engage the second telescoping member 122 when the third telescoping member 126 has reached its maximum extended limit.

FIG. 8 is an illustration of the extension 100 in its retracted position. This illustration clearly indicates how the length of the extension 100 may be reduced to its minimal length for shipping, storage, and yard maintenance.

Figure 3:
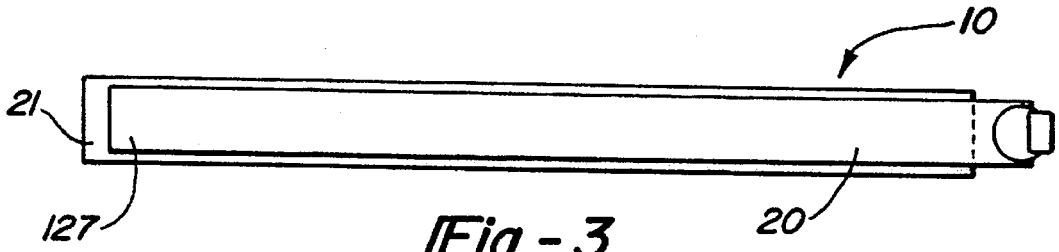
FIG. 3 is a top view of the extension assembly of the present invention.
Figure 5:
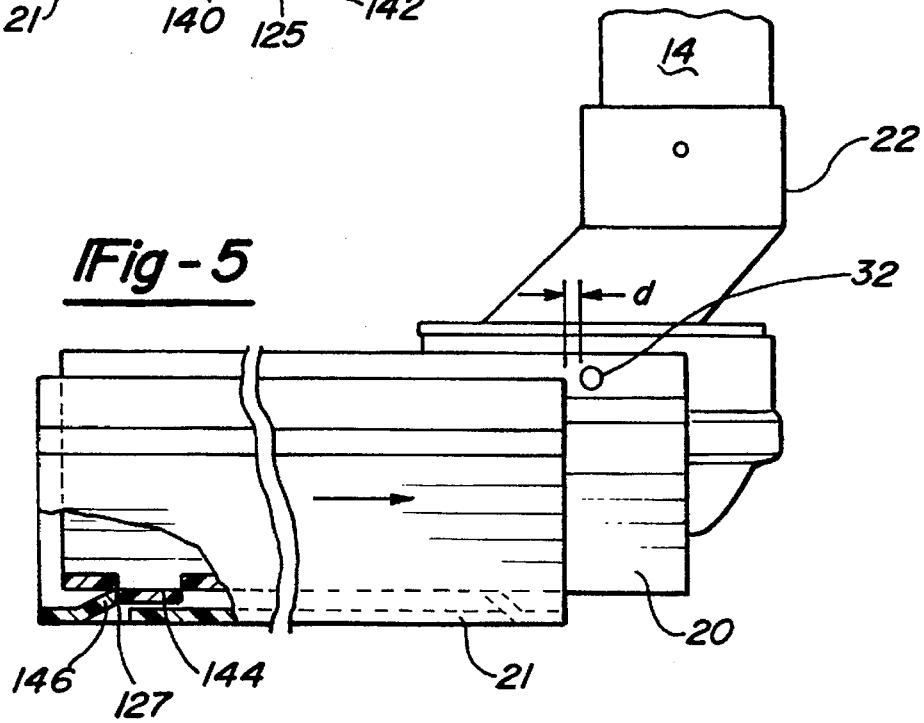
FIG. 5 is a side view of the extension assembly shown in partial cross section and showing retraction stops.

With reference to FIGS. 3 and 5, in a preferred embodiment, one or more retraction stops 127 are provided between the first and second extensions 20, 21 and stoppingly engage the second extension 21 when the second extension 21 is in its retracted position. This prevents contact with and potential breakage of the fastener 32 by the second extension 21 by allowing a distance "d" between the retracted second extension 21 and the fastener 32. Preferably, the retraction stop 127 comprises the junction of an outward protrusion 144 on the first extension 20 and an inward protrusion 146 on the second extension 21, as best shown in FIG. 5. Additional retraction stops 127 can also be provided on additional extension members.

Referring to FIG. 9, a cross-sectional view of the extension 100 is illustrated as shown along the line 9—9 of FIG. 8. This view illustrates the interattachment of the extension elements with each other. The second telescoping extension member 122 includes an overlapping flange 130 that overrides the upper edge of the first extension member 118 as the member 122 is extended. Similarly, the third telescoping extension member 126 includes an overlapping flange 132 that overrides the top side of the overlapping flange 130 of the second telescoping extension member 122.

Preferably, the collar adaptor 16, the rotatable collar 18, and the extension 100 may be composed of a polymerized material, such as a plastic or a vinyl. Alternatively, the extension 100 may be composed of a metal such as aluminum.

Having described my invention, however, many modifications thereto will become apparent to those skilled in the art to which it pertains without deviation from the spirit of the invention as defined by the scope of the appended claims.

I claim:

1. In an assembly for attachment to the lowermost region of a rainwater downspout, said assembly comprising an adaptor for attachment to the lowermost end of a rainwater downspout, a rotatable collar having a front half and a back half rotatably attached to said adaptor, said collar forming an opening, a rainwater deflector extending downwardly and inwardly from said back half of said rotatable collar, said deflector having a bottom portion covering a portion of said opening, and a rainwater channel extension attached to a first and a second side of said rotatable collar, wherein the improvement comprises a downwardly extending lip along a bottom edge of said bottom portion of said rainwater deflector.

2. In an assembly for attachment to the lowermost region of a rainwater downspout, said assembly comprising an adaptor fitted to said lowermost region of said downspout, a first rainwater channel extension having a first end and a second end attached to said adaptor, and a second rainwater channel extension having a first end and a second end slidably attached to said first rainwater extension, wherein the improvement comprises a retraction stop, said retraction stop comprising a junction of an outward protrusion adjacent said second end of said first extension and an inward protrusion adjacent said second end of said second extension, whereby said second extension is prevented from sliding over said first extension into a fully retracted position.

3. The assembly of claim 2 further comprising an extension stop, wherein said extension stop comprises a junction of an outward protrusion adjacent said second end of said first extension and an inward protrusion adjacent said first end of said second extension.

4. The assembly of claim 2 wherein said retraction stop is disposed between said second extension and a third extension.

5. The assembly of claim 3 wherein said extension stop is disposed between said second extension and a third extension.

* * * * *